US007699278B2

(12) United States Patent
Goldstein

(10) Patent No.: US 7,699,278 B2
(45) Date of Patent: Apr. 20, 2010

(54) CURTAIN RODS AND BRACKETS

(75) Inventor: Allan Goldstein, Old Tappan, NJ (US)

(73) Assignee: Source Global Enterprises, Inc., Bronx, NY (US)

( * ) Notice: Subject to any disclaimer, the term of this patent is extended or adjusted under 35 U.S.C. 154(b) by 0 days.

(21) Appl. No.: 12/183,209

(22) Filed: Jul. 31, 2008

(65) Prior Publication Data

US 2009/0032659 A1 Feb. 5, 2009

Related U.S. Application Data

(60) Provisional application No. 60/953,397, filed on Aug. 1, 2007.

(51) Int. Cl.
*A47B 96/06* (2006.01)

(52) U.S. Cl. ..... 248/220.21; 248/221.11; 248/222.14; 248/262

(58) Field of Classification Search ..... 248/220.21, 248/251, 229.1, 221.11, 222.13, 222.14, 248/254, 262; 211/105.1, 123; 256/59
See application file for complete search history.

(56) References Cited

U.S. PATENT DOCUMENTS 302,773 A * 7/1884 Peters ..... 248/251
2,807,834 A * 10/1957 Blum ..... 248/251
3,071,350 A * 1/1963 Opie ..... 256/65.08
3,164,354 A * 1/1965 Murdock ..... 248/251
3,239,070 A * 3/1966 Clauson ..... 211/105.1
3,258,250 A * 6/1966 Mcmullin ..... 256/13.1
3,544,072 A * 12/1970 Thom ..... 256/59
3,842,564 A * 10/1974 Brown ..... 52/717.03
D256,864 S * 9/1980 Nippel et al. ..... D6/549
4,220,316 A * 9/1980 Naka et al. ..... 256/59
5,531,416 A * 7/1996 Remmers ..... 248/222.51
D540,146 S * 4/2007 Berberet ..... D8/316

* cited by examiner

*Primary Examiner*—Korie Chan
(74) *Attorney, Agent, or Firm*—Levine & Mandelbaum

(57) ABSTRACT

Apparatus for hanging curtains from wall brackets includes a hollow cylindrical rod with a longitudinal slot in its wall through which an interior clamping member for each wall bracket may be inserted. The clamping member is secured to a respective bracket by one or more screws which extend from outside of the rod to the clamping member captured within the rod. C-shaped rings mounted on the rod have openings to allow passage of the rings along the rod without coming into contact with the brackets. Each ring has a downward extending projection, e.g., a tab, which can be apertured to receive a hook, clip or other fastener attached to the curtains.

12 Claims, 8 Drawing Sheets

CURTAIN RODS AND BRACKETS

BACKGROUND OF THE INVENTION

It is known to hang curtains from traverse rods which permit curtains to be drawn open and closed along the length of the rod. Such rods employ sliders which are mounted within an opening in the rod and having openings to receive hooks attached to the tops of the curtains. Such rods, sliders and hooks are generally unsightly and are shielded from view by the tops of the curtains.

It is also known in the art to hang curtains from attractive rings slidably mounted on a cylindrical decorative rod which is, in turn, mounted on brackets fixed to a wall. Such rods and rings have an aesthetically pleasing look which complements the view offered by the curtains.

In addition a having one bracket near each end of the rod, one or more intermediate brackets may be needed to support a decorative rod between its ends to prevent sagging of the rod. The number of brackets needed depends on the length of the rod, the thickness of the rod, the material from which the rod is fabricated, and the number of sections of the rod if the rod is a telescoping rod.

A problem arises when the curtains are to be opened and closed in that the rings can only slide along segments of the rod that are disposed between two adjacent brackets as the brackets prevent movement of the rings from one side of a bracket to the other side.

SUMMARY OF THE INVENTION

The present invention overcomes the aforesaid shortcomings of prior art decorative rods and rings in providing a construction whereby curtains can be hung from rings slidably mounted on a decorative rod and fully slidable along substantially the full length of the rod without interference from the brackets.

This is achieved by providing a hollow cylindrical rod with a longitudinal slot in its wall through which an interior clamping member of each bracket may be inserted. The clamping member is secured to its bracket by one or more screws which extend from outside of the rod to the clamping member captured within the rod.

In a first embodiment of the invention, the rod is mounted with the slot facing downwardly. A planar clamping member having a central threaded aperture is inserted into an open end of the hollow cylindrical rod. A screw is passed through an aperture in a portion of the bracket external to the rod and threaded into the aperture in the clamping member thereby sandwiching the wall of the rod between the clamping member and the portion of the bracket external to the rod. As the screw is tightened, the rod is frictionally secured to the bracket.

The portion of the bracket external to the rod which engages the rod is at the end of an upward rising portion of the bracket at the end of a generally horizontal arm which dips and then rises as it extends from the wall toward the rod. The rings mounted on the rod have openings, i.e., they are C-shaped, to allow passage of the rings along the rod without coming into contact with the brackets. Each ring has a downward extending projection, e.g., a tab, which can be apertured to receive a hook, clip or other fastener attached to the curtains. The placement of the opening in the curtain ring is selected to be near the bottom of the ring, i.e., proximate the tab from which the curtain is to be hung, so that when a vertical force is applied to the ring by the weight of the curtain, the external end of the bracket passes through the opening in the ring as the ring is slid along the rod and passed the bracket upward sloping arm.

In a second embodiment of the invention, the rod is mounted with the slot facing rearwardly, i.e., toward the wall. A planar support member extending away from the wall has mounted on its end, distal from the wall, a substantially planar clamping member orthogonal to the support member, i.e., in a vertical plane. The support member intersects the clamping member along a horizontal centerline of the clamping member.

Two screws are passed through respective laterally disposed apertures in the clamping member thereby sandwiching the wall of the rod between the clamping member and the heads of the screws, the screw heads having diameters larger than the width of the slot in the rod. As the screws are tightened, the rod is frictionally secured to the bracket.

The rings mounted on the rod have openings, i.e., they are C-shaped, to allow passage of the rings along the rod without coming into contact with the brackets. Each ring has a downward pointing projection, e.g., a tab, which can be apertured to receive a hook, clip or other fastener attached to the curtains. The placement of the opening in the curtain ring of the second embodiment is selected to face rearwardly, toward the wall, so that when a vertical force is applied to the ring by the weight of the curtain, the planar support member of the bracket passes through the opening in the ring as the ring is slid along the rod and passed the bracket.

It is therefore an object of the invention to permit curtains on hooks hung on an adjustable tubular curtain rod to be moved along the axis of the rod without interference from the wall brackets on which the rod is mounted. This is achieved by having a slit along the full length of the rod; having the brackets penetrate into the slit in the rod; and where the slit is on the bottom of the rod, using open hooks which rest on the top of the rod; and where the slit is along the back of the rod, using open hooks with an opening smaller than the diameter of the rod, which hooks can be slid onto the rod from an end of the rod.

DESCRIPTION OF THE PREFERRED EMBODIMENT

Figure 1:
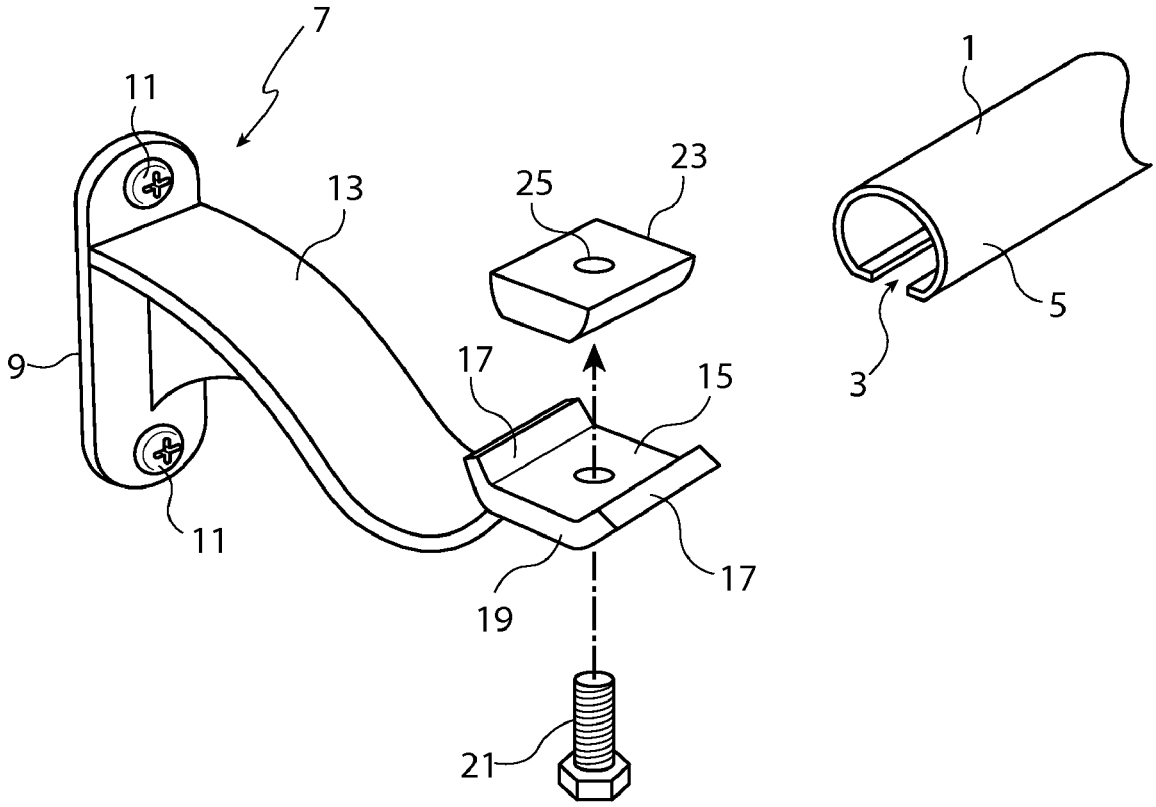
FIG. 1 is a perspective view of a first embodiment of the invention during a first stage of use.

Referring now to FIG. 1 of the drawings, there is shown a first embodiment of the invention in which a hollow cylindrical curtain rod 1 has a longitudinal slot 3 in its wall 5 running the entire length of the rod 1.

Attachable to a wall (not shown) is a curtain rod bracket 7 having a conventional wall mounting flange 9 with apertures for receiving screws 11 or similar fasteners for mounting the bracket on the wall.

Extending outwardly from the flange 9 is an arm 13 which dips downwardly and then rises again with distance from the wall. The arm 13 may be formed from a planar length of metal or other rigid material and bent to achieve the shape shown in FIG. 1.

Mounted atop the outward end of the arm 13 is a tray 15 having a planar bottom and opposite upward sloping walls 17, each wall 17 occupying a plane parallel to the axis of the curtain rod 1. The distance between the free edges of the walls 17 is preferably less than the diameter of the rod 1 and greater than the width of the slot 3 in the rod 1.

The tray 15 is provided with a central aperture 19 in its bottom having a diameter large enough to enable the shank of a screw 21 to be passed therethrough but smaller than the diameter of the head of the screw 21 for preventing the head of the screw from being passed therethrough.

A generally rectangular planar clamping piece 23 has a central aperture 25 with threads complementary to the threads on the screw 21.

Figure 2:
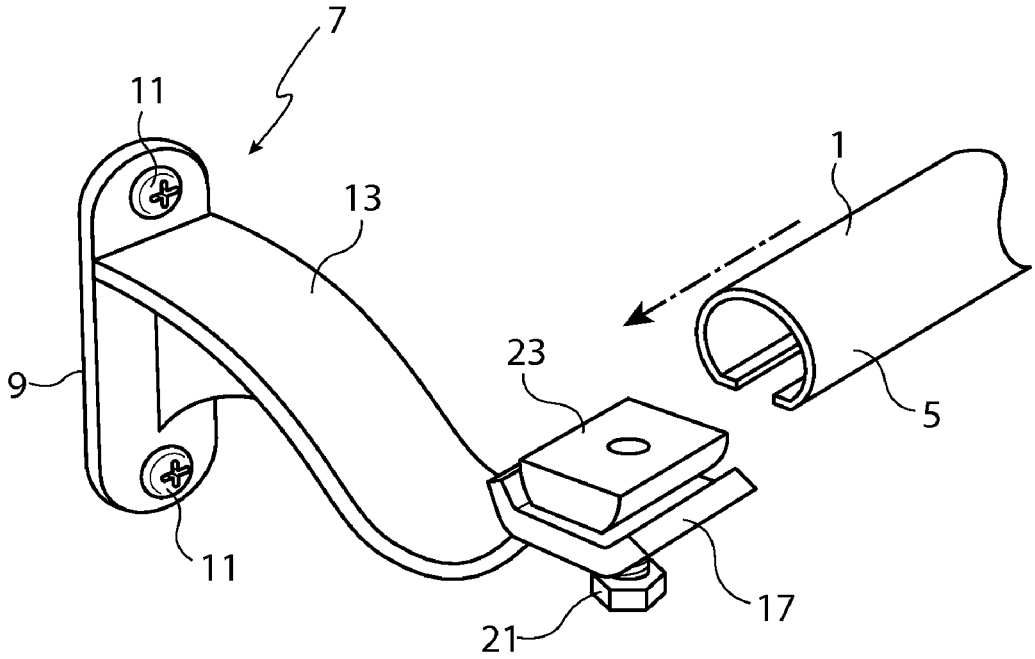
FIG. 2 is a perspective view of the first embodiment of the invention during a second stage of use.

Referring now to FIG. 2, preparatory to mounting the curtain rod 1 on the bracket 7, the clamping member 23 is loosely threaded onto the screw 21 after passing the screw 21 upwardly through the aperture 19 in the tray 15, thereby leaving sufficient space between the tray 15 and clamping member 23 for passing the slotted wall of the rod 1 over the tray 15 as the clamping member enters the hollow interior of the rod 1 with the shank of the screw 21 disposed within the slot of the rod 1. In order to enable the rod 1 to be freely slidable on the bracket 7 in a direction parallel to the rear wall mounting surface of the flange 11, the shank of the screw 21 has a diameter less than the width of the slot 3 of the rod 1.

Figure 3:
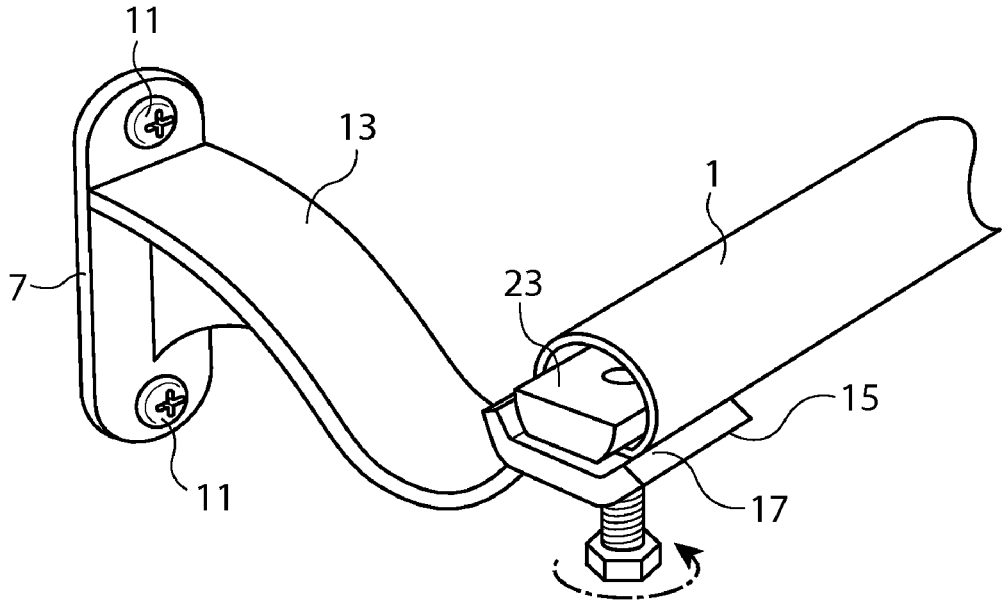
FIG. 3 is a perspective view of the first embodiment of the invention during a third stage of use.

Referring now to FIG. 3 of the drawings, once an end of the rod 1 is slid between the tray 15 and clamping piece 23 to its desired position relative to the bracket 7, as described above, the screw 21 is tightened whereby the portion of the wall of the rod 1 adjacent the slot 3 is sandwiched and frictionally held between the tray 7 and clamping piece 23. The free edges of the walls 17 of the tray 15 are preferably sufficiently close together to engage the circumference of the rod 1 as the screw 21 is tightened, thereby enhancing the grasp of the bracket 7 on the rod 1 and preventing any tendency of the rod 1 to turn or twist with respect to the bracket 7.

Figure 4:
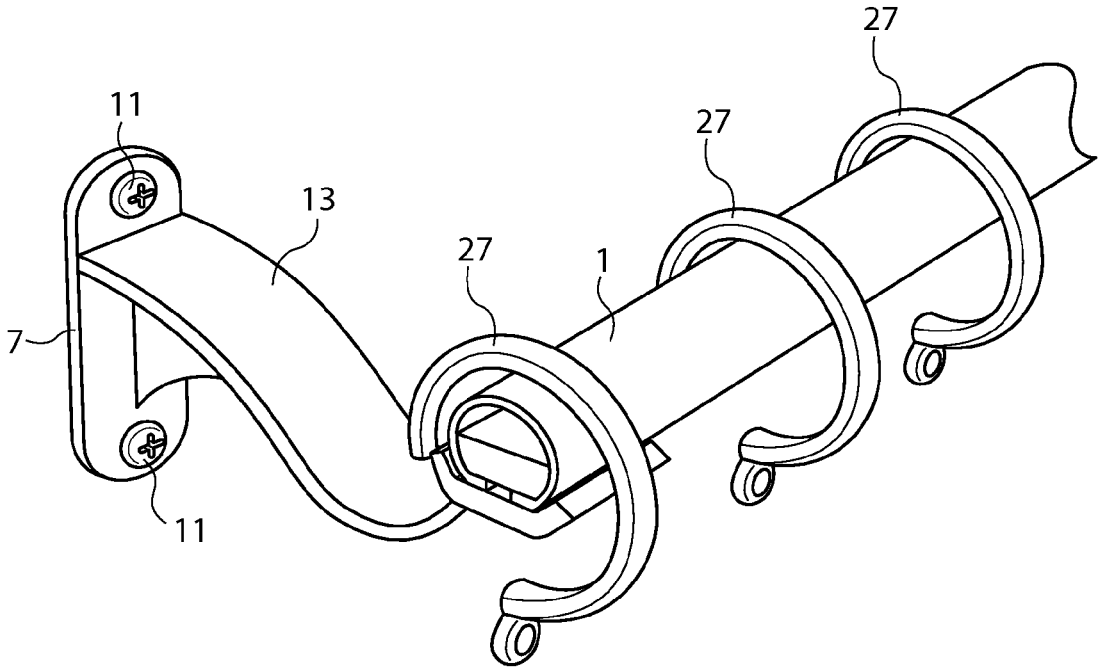
FIG. 4 is a perspective view of the first embodiment of the invention during a fourth stage of use.

Referring now to FIG. 4, once the rod 1 is secured to the bracket 7 as described above, one or more rings 27, each of which C-shaped to allow passage of the rings 27 along the rod 1 without coming into contact with the brackets 7, is slid over the rod 1. If the openings in the rings 27 are narrower than the diameter of the rod 1, the rings are slid over the rod at one of its two free ends and slid along the rod 1 over the bracket(s) 7.

If the openings in the rings 27 are wider than the diameter of the rod 1, the rings 27 can be hooked over the rod 1 between its two free ends and still slid along the rod 1 over the bracket(s) 7 as necessary to position the rings or to draw the curtains.

Figure 5:
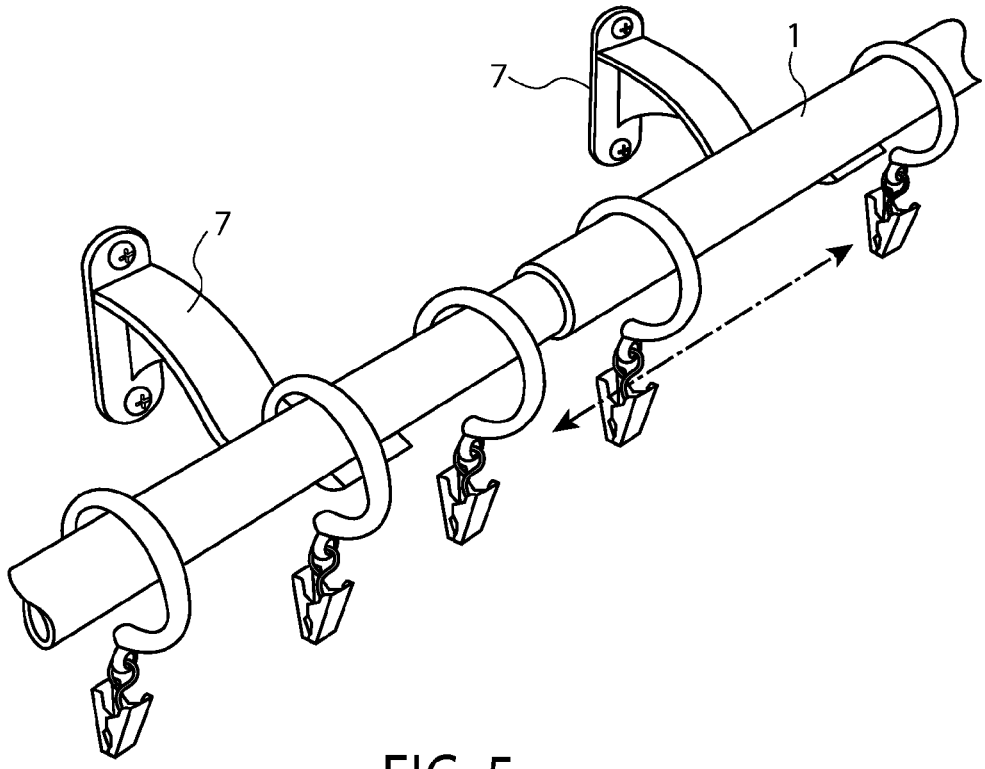
FIG. 5 is a perspective view of the first embodiment of the invention during a fifth stage of use.

Referring now to FIG. 5 of the drawings, there is shown an intermediate segment of the rod 1, between its free ends, mounted on two additional brackets 7 identical to the bracket 7 shown in FIG. 4 on which an end of the rod 1 is mounted. It is to be appreciated that any number of laterally aligned brackets may be provided along the wall and that the rod may be mounted on all of them by sliding it over each bracket as the rod is moved in a direction parallel to the wall mounting surfaces of the flanges 9 before the screws 21 are tightened.

Figure 6:
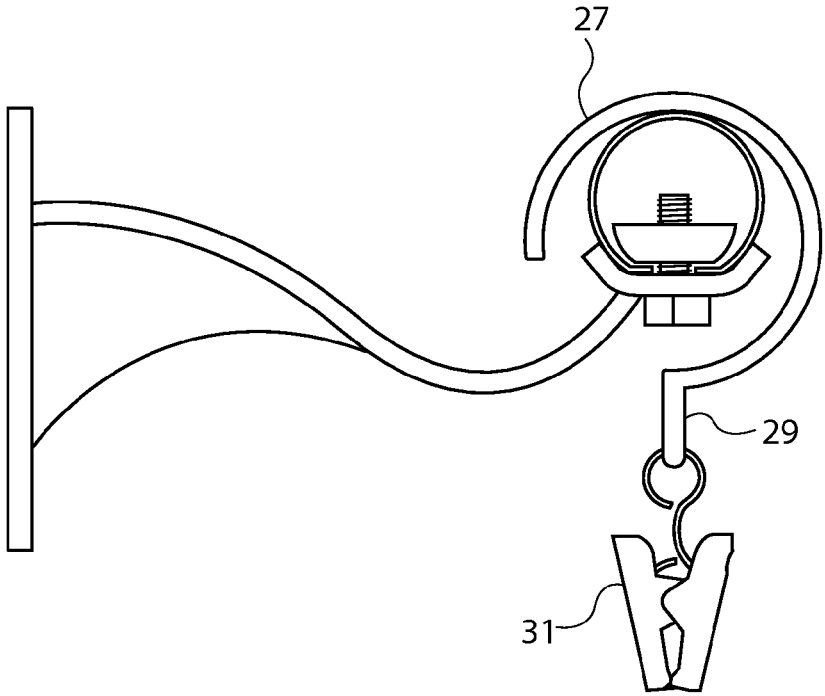
FIG. 6 is a side view of a portion of the first embodiment of the invention during the fifth stage of use.

Referring now to FIG. 6 of the drawings, each ring 27 has a downward extending projection 29, e.g., a tab, which can be apertured to receive a fastener 31 which may be a clip, hook, or other type of fastener for attachment to the curtains. The placement of the opening in the curtain ring 27 is selected to be near the bottom of the ring, i.e., proximate the tab 29 from which the curtain is to be hung, so that when a vertical force is applied to the ring 27 by the weight of the curtain, the external end of the bracket 7 passes through the opening in the ring 27 as the ring 27 is slid along the rod 1 and passed the upward sloping arm 13 of the bracket 7.

Figure 7:
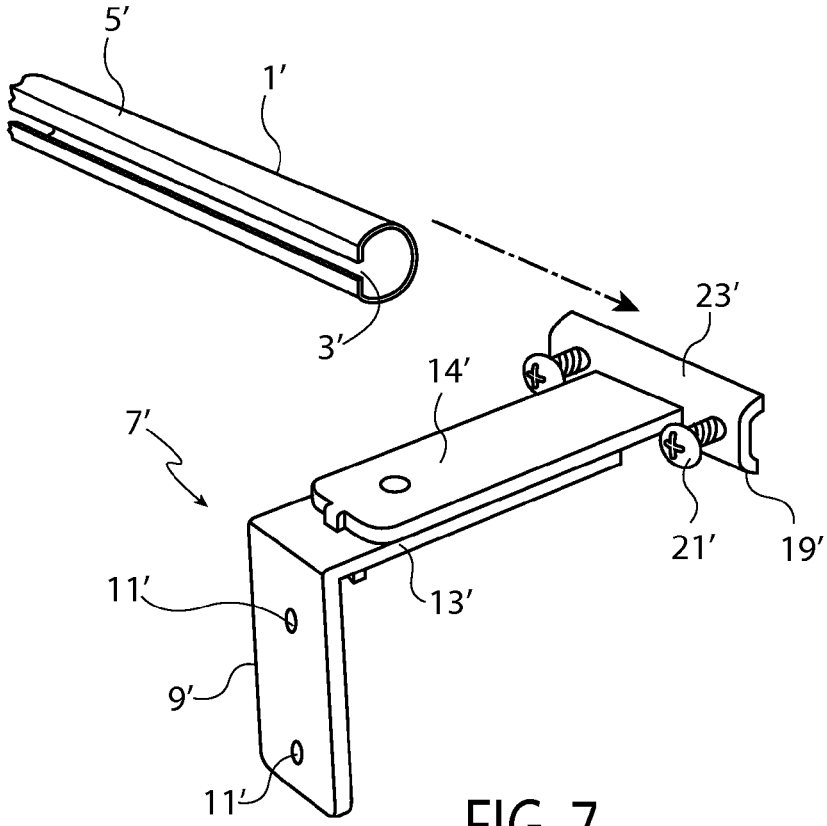
FIG. 7 is a perspective view of a second embodiment of the invention during a first stage of use.

Referring now to FIG. 7 of the drawings, there is shown a second embodiment of the invention in which a hollow cylindrical curtain rod 1' has a longitudinal slot 3' in its wall 5' running the entire length of the rod 1'.

Attachable to a wall (not shown) is a curtain rod bracket 7' having a conventional wall mounting flange 9' with apertures 11 for receiving screws or similar fasteners for mounting the bracket on the wall.

Extending outwardly from the flange 9 is a planar arm 13' having a central longitudinal slot. Slidably mounted atop the arm 13' is a planar support member 14' having a downward projecting tongue 18' slidably received in the slot. The planar support member 14' has an aperture spaced from and in axial alignment with the tongue 18' for receiving a screw 20' passed through the slot. The aperture in the planar support member 14' is threaded for receiving the complementary threads of the screw 20' which may be loosened to permit longitudinal relative movement between the arm 13' and planar support member 14' with the tongue 18' and screw 20' preventing relative rotation between the arm 13' and planar support member 14'. The screw 20' may then be tightened to prevent relative movement between the arm 13' and slide 14'.

The planar support member 14' has mounted on its end, distal from the flange 9', a substantially planar clamping member 23' orthogonal to support member 14', i.e., in a vertical plane. The support member 14' intersects the clamping member 23' along a horizontal centerline of the clamping member.

Clamping member 23' has a planar vertical wall 15' and opposite outward sloping top and bottom walls 17', each wall 17' occupying a plane parallel to the axis of the curtain rod 1'. The distance between the free edges of the walls 17' is less than the inner diameter of the rod 1' and greater than the width of the slot 3' in the rod 1'.

The wall 15' is provided with two laterally spaced apertures 19' on opposite sides of the support member 14' having diameters large enough to enable the shanks of screws 21' to be passed therethrough but smaller than the diameters of the heads of the screws 21' for preventing the heads of the screws from being passed therethrough.

Figure 8:
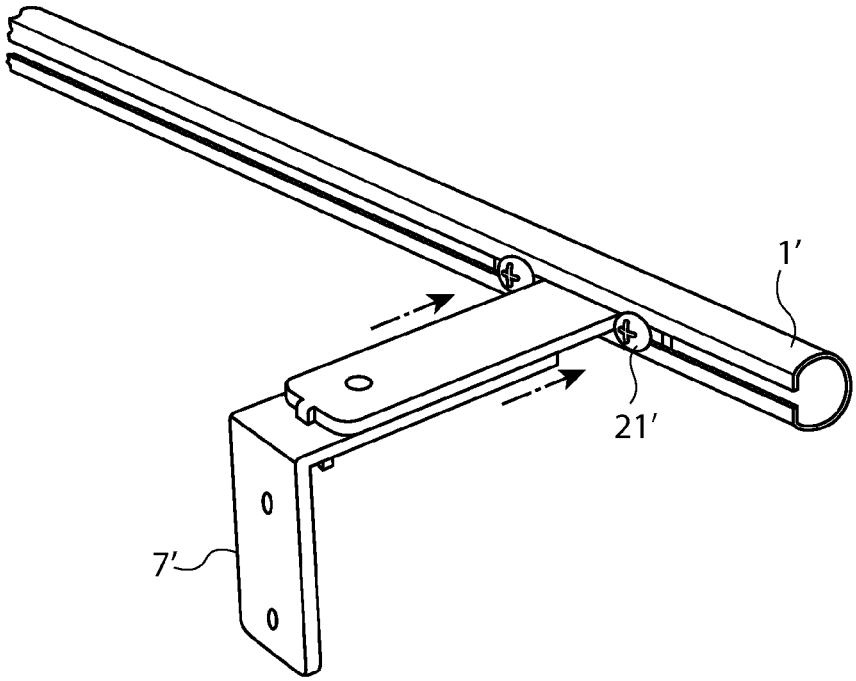
FIG. 8 is a perspective view of the second embodiment of the invention during a second stage of use.

Referring now to FIG. 8, preparatory to mounting the curtain rod 1' on the bracket 7', the clamping member 23' is caused to enter the hollow interior of the rod 1' with the shanks of the screws 21' disposed within the slot 3' of the rod 1'. In order to enable the rod 1' to be freely slidable on the bracket 7' in a direction parallel to the rear wall mounting surface of the flange 11', the shanks of the screws 21' have diameters less than the width of the slot 3' of the rod 1'.

Once an end of the rod 1' is slid between the heads of the screws 21' and the clamping member wall 15' to its desired position relative to the bracket 7', as described above, the screws 21' are tightened whereby the portion of the wall of the rod 1' adjacent the slot 3' is sandwiched and frictionally held between the clamping member wall 15' and heads of the screws 21'. The free edges of the walls 17' of the clamping member 23' are preferably sufficiently close together to engage the circumference of the rod 1' as the screws 21' are tightened, thereby enhancing the grasp of the bracket 7' on the rod 1' and preventing any tendency of the rod 1' to turn or twist with respect to the bracket 7'.

Figure 9:
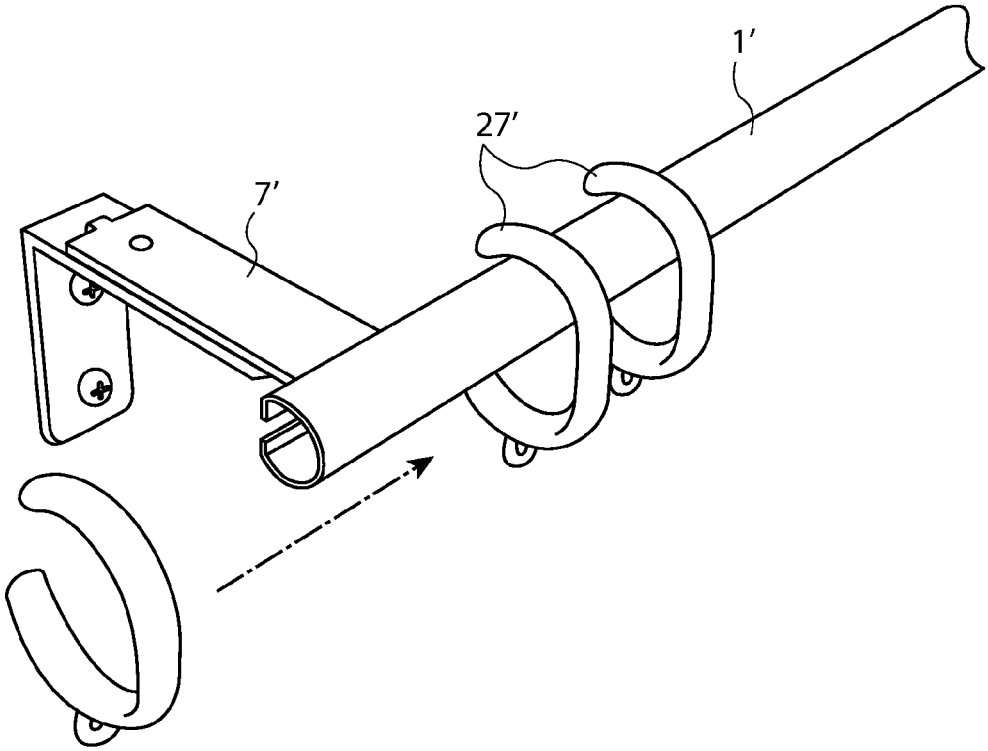
FIG. 9 is a perspective view of the second embodiment of the invention during a third stage of use.
Figure 10:
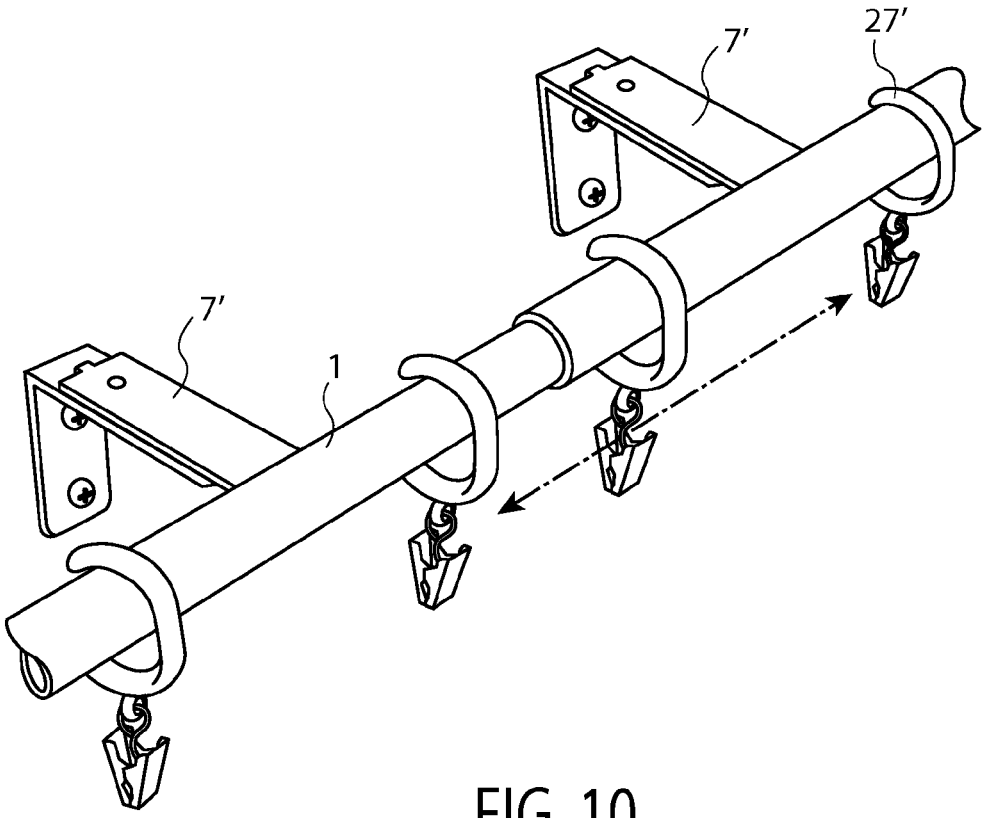
FIG. 10 is a perspective view of the second embodiment of the invention during a fourth stage of use.

Referring now to FIGS. 9 and 10, once the rod 1' is secured to the brackets 7' as described above, one or more rings 27', each of which C-shaped to allow passage of the rings along the rod 1' without coming into contact with the brackets 7', is slid over the rod 1'.

Figure 11:
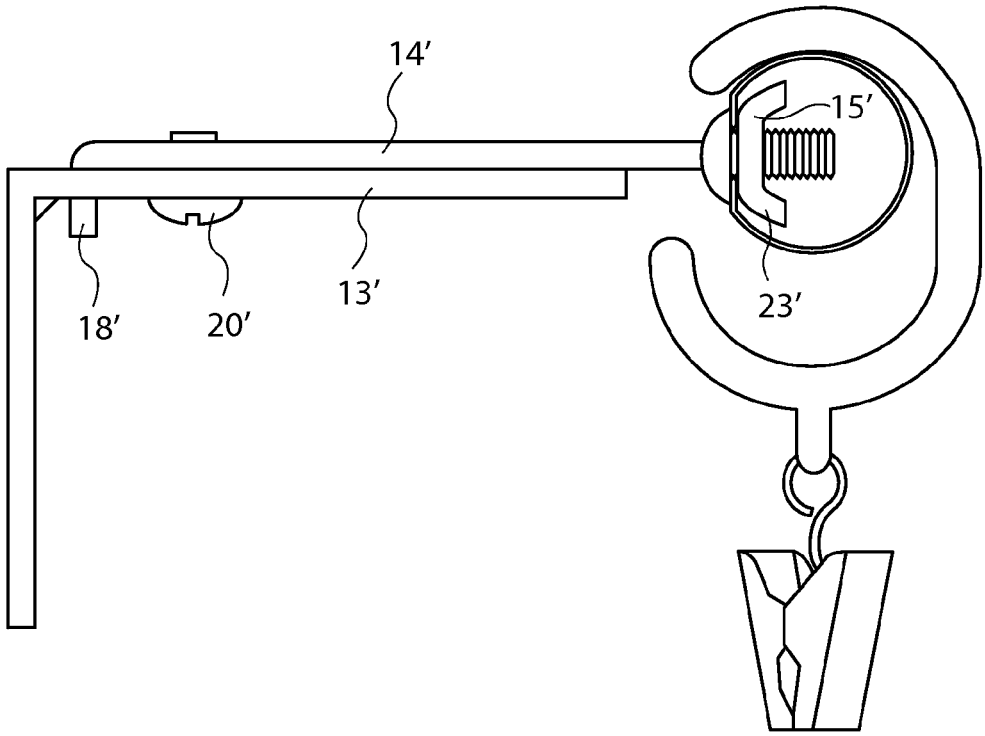
FIGS. 11 and 12 are side views of the second embodiment of the invention during a fourth stage of use and a fifth stage of use, respectively.
Figure 12:
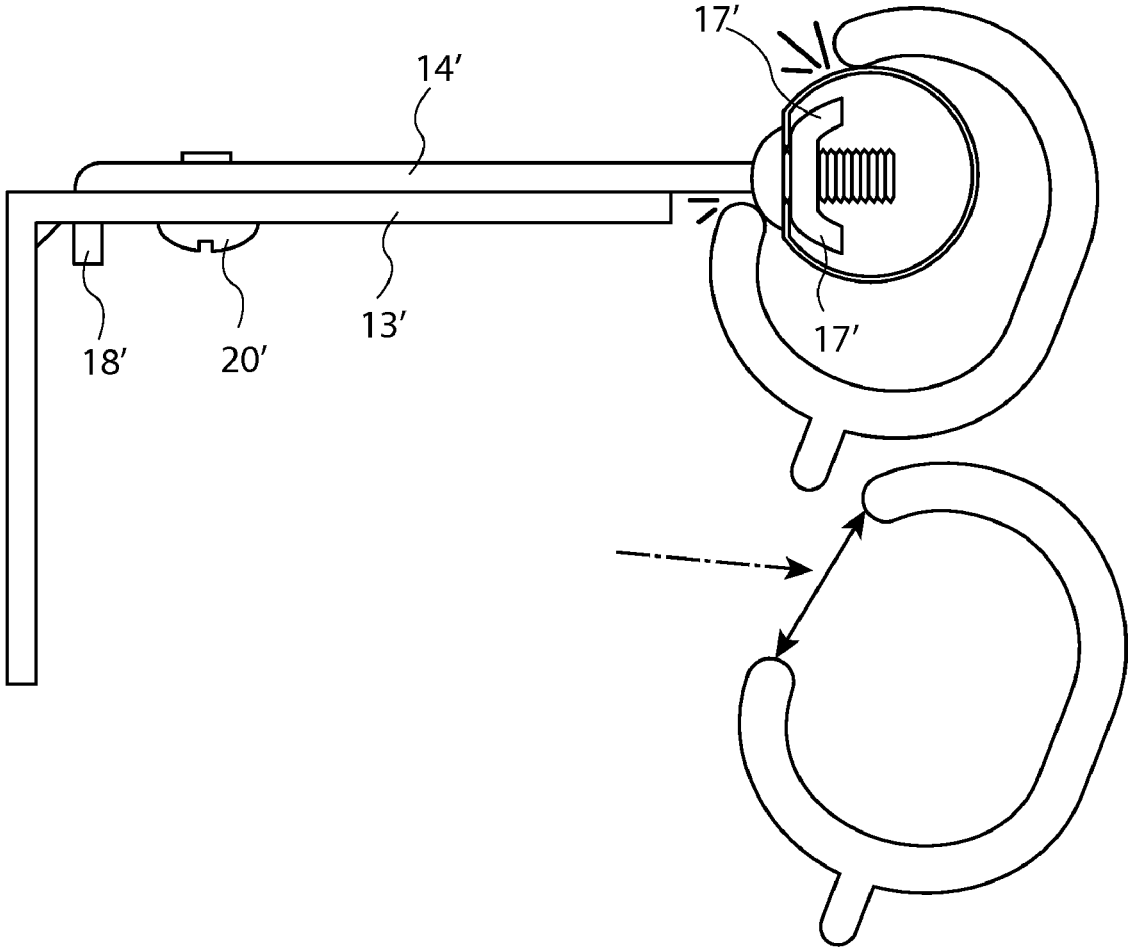

In the second embodiment of the invention, because the rod 1' is mounted with its slot facing rearward as shown in FIG. 11, the openings in the rings 27' may turn upwards during movement of the curtains to a position illustrated in FIG. 12, thereby enabling separation of a ring with an opening larger than the diameter of the rod 1' from the rod 1'. Accordingly, the openings in the rings 27' are preferably narrower than the diameter of the rod 1' as shown in FIG. 12, and the rings 27' are slid over the rod 1' from one of its two free ends and slid along the rod 1' over the bracket(s) 7.

Figure 13:
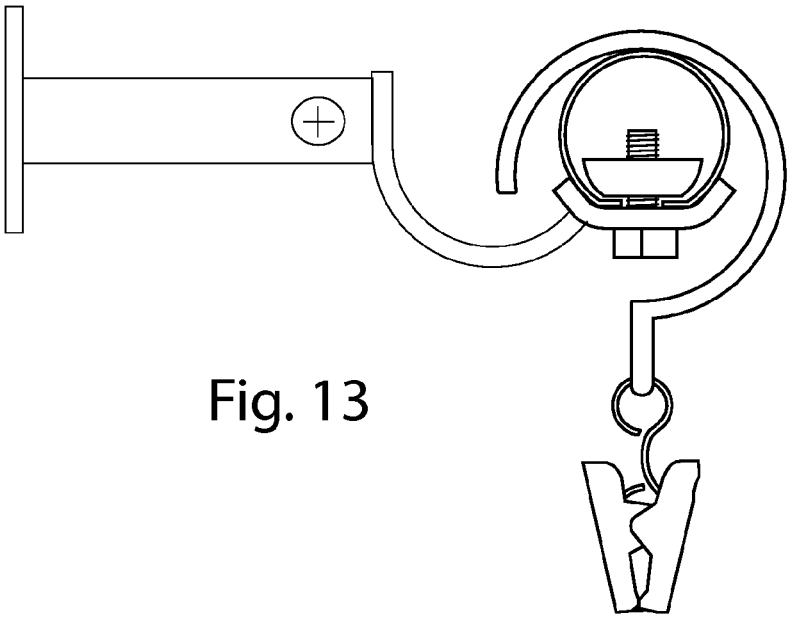
FIGS. 13 and 14 are side views of a variation of the invention showing an alternate component in a collapsed state and an extended state, respectively.
Figure 14:
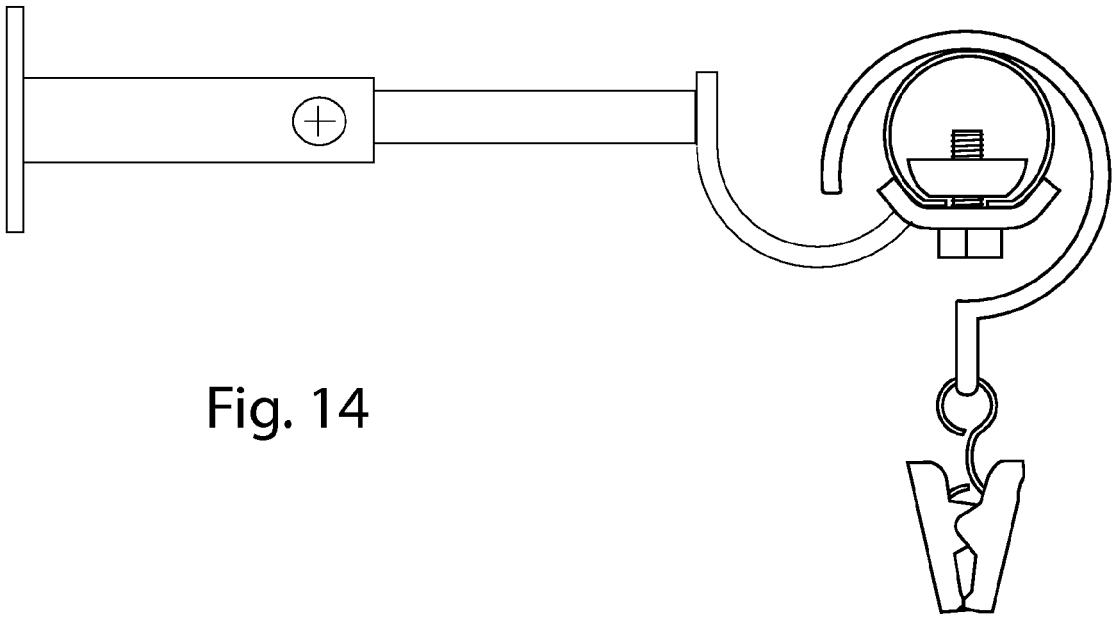

It is to be appreciated that modifications and variations may be made to the embodiments herein disclosed without departing from the spirit and scope of the invention. For example, the wall bracket may be a circular cylindrical telescoping bracket as shown in FIGS. 13 and 14.

What is claimed is:

1. Apparatus for hanging curtains comprising, an elongated hollow tubular rod having an axial bore and a cylindrical wall with a downward facing open slot parallel to an axis of said rod, a bracket having a wall-engaging part for being affixed to the surface of a wall, an arm having one end mounted on said wall-engaging part and an opposite free end, a tray member integral with said free end of said arm and immovable relative thereto, said tray member of said bracket engaging a portion of said cylindrical wall of said rod adjacent said slot, a clamping member disposed within said bore, and a fastener having a diameter less than the width of said slot for passing therethrough and engaging said clamping member with said portion of the wall of said rod captured between said clamping member and said tray member of said bracket, said tray member of said bracket urged against an outer cylindrical surface of said wall of said rod when said fastener is tightened thereby preventing axial movement of said rod relative to said bracket, and said tray member of said bracket releasable from said outer cylindrical surface of said wall of said rod when said fastener is loosened thereby permitting axial movement of said rod relative to said bracket, and at least one traveler slidably mounted on the outside of said rod, said traveler being in the form of a generally C-shaped ring with an opening, said traveler being adapted to support a portion of a curtain suspended therefrom, the opening in said traveler being in a position for receiving said arm of said bracket as said traveler, supporting the weight of said curtain, is slid along said rod from one side of said bracket to an opposite side of said bracket without contacting said bracket.

2. Apparatus for hanging curtains according to claim 1 wherein said fastener has a head which engages said bracket for affixing said clamping member to said bracket.

3. Apparatus for hanging curtains according to claim 1 in which said arm has a portion intermediate said one end and said free end which is lower in elevation than said free end when said bracket is affixed to said wall.

4. Apparatus for hanging curtains according to claim 1 further comprising a tray mounted on said free end of said arm, said tray having spaced walls with free edges separated by a distance less than the diameter of said rod and greater than the width of said slot.

5. Apparatus for hanging curtains according to claim 1 wherein said clamping member comprises a generally planar piece with an aperture, and said fastener comprises a screw adapted to be threaded into said aperture.

6. Apparatus for hanging curtains according to claim 3 wherein said arm portion intermediate said one end and said free end dips and then rises as it extends from the wall toward the rod thereby forming a valley in said arm between said one end and said free whereby a portion of said traveler can pass through said valley without interference from said bracket.

7. Apparatus for hanging curtains according to claim 6 wherein said arm has a curve between said one end and said free end in which said valley is disposed.

8. Apparatus for hanging curtains according to claim 6 wherein said rod is mounted remote from said valley.

9. Apparatus for hanging curtains according to claim 6 wherein said valley is free of any obstruction which could interfere with movement of said traveler from one side of said bracket to an opposite side of said bracket.

10. Apparatus for hanging curtains according to claim 1 wherein a portion of said traveler, slidably mounted on the outside of said rod, adjacent and above said opening has a lower elevation than the uppermost portion of said arm and a higher elevation than the lowermost portion of said arm.

11. Apparatus for hanging curtains according to claim 1 wherein said free end of said arm has a higher elevation than the lowermost portion of said arm.

12. Apparatus for hanging curtains according to claim 1 wherein said rod is a telescoping rod having a plurality of sections, the length of said rod being adjustable by sliding at least one of its sections relative to said bracket when said fastener is loosened and the length of said rod being fixed when said fastener is tightened.

* * * * *